US005597029A

United States Patent [19]

Landua

[11] Patent Number: 5,597,029

[45] Date of Patent: Jan. 28, 1997

[54] SHOOTING HEAD FOR A CORE SHOOTER

[75] Inventor: Werner Landua, Mannheim, Germany

[73] Assignee: Adolf Hottinger Maschinenbau GmbH, Mannheim, Germany

[21] Appl. No.: 591,504

[22] PCT Filed: Jul. 16, 1994

[86] PCT No.: PCT/DE94/00821

§ 371 Date: Feb. 5, 1996

§ 102(e) Date: Feb. 5, 1996

[87] PCT Pub. No.: WO95/04620

PCT Pub. Date: Feb. 16, 1995

[30] Foreign Application Priority Data

Aug. 4, 1993 [DE] Germany ..... 43 26 180.9

[51] Int. Cl.[6] ..... B22C 13/12; B22C 15/26

[52] U.S. Cl. ..... 164/200; 164/22

[58] Field of Search ..... 164/200, 201, 164/202, 19, 20, 21, 22

[56] References Cited

U.S. PATENT DOCUMENTS 3,863,705 2/1975 Leeson ..... 164/202

5,524,703 6/1996 Landua et al. ..... 164/201 X

FOREIGN PATENT DOCUMENTS 4128952 7/1992 Germany .

2001268 1/1979 United Kingdom .

OTHER PUBLICATIONS

Technische Umschau; "*Schiessen statt Rütteln zur Vorverdichtung beim Hochdruckformen*", Giesserei vol. 64, No. 25; (1977–12); Seite 675.

*Primary Examiner*—J. Reed Batten, Jr.

*Attorney, Agent, or Firm*—Bell, Seltzer, Park & Gibson, P.A.

[57] ABSTRACT

The shooting has an opening (1) at its inlet side for selective connection to a filling device or a clamping head for sealingly applying compressed air. The filling device has an outlet member that immerses into the shooting head and predetermines therein a filling level (5). At its outlet side, the shooting head has a shooting plate (4) which shooting nozzles (3). In order to automatically produce core packs when the difference in weight is extreme between the individual cores, a core sand guide system (6) extends inside the shooting head substantially from the lower edge of the outlet member immersed to its deepest level in the shooting head, or from the filling level (5) defined by the outlet member, to the shooting nozzles (3).

7 Claims, 3 Drawing Sheets

SHOOTING HEAD FOR A CORE SHOOTER

BACKGROUND OF THE INVENTION

The invention relates to a shooting head for a core shooter for shooting foundry cores or molds, the shooting head having an opening at its inlet end for selective connection to a filling device immersing with a discharge end or outlet member into the shooting head and predetermining the filling level, or to a clamping head serving to sealingly apply compressed air, and a shooting plate arranged at its outlet end and comprising shooting nozzles.

Core shooters with shooting heads of the kind under discussion have been known from practice for a long time. For example, reference may be made to DE 41 28 952 C1.

However, within the scope of an automatic production of core packs, the known shooting heads of the described kind are problematic. Depending on the core being shot, differences in shooting weights from 60 kg to 1 kg occur, the shooting heads being normally capable of receiving core sand in a quantity of at most 70 kg. Regardless of the size of the core being shot, the outside dimensions of the shooting heads are however predetermined, in particular in the automatic production of core packs. This means that the shooting heads in the core shooter must be exchangeable regardless of the cores being shot. Consequently, in the case of shooting very small cores, there is a large supply of sand and binding agents in the interior of the shooting head, the small shooting weight causing only a small throughput of core sand and binding agents. In the presence of large supplies of sand in the shooting head, and in particular as a result of the temperature inside the shooting head, which is about 35° C., this small throughput leads to an ageing of the binding agent that is mixed with the core sand, so that cores shot with a very small throughput of sand often lack adequate strength.

Furthermore, it is necessary that the compressed air required for the shooting penetrate through the entire sand supply within the shooting head, so that a rather considerable compression occurs already in the shooting head, which complicates the shooting of the cores, or makes it even impossible when lumps form in the region upstream of the nozzles.

It has already been proposed in DE 41 28 952 C1 to alleviate the problem of penetrating the sand supply with compressed air inside the shooting head to the extent that a filling device or an outlet member thereof immersing into the shooting head fills the shooting head to a certain, predetermined filling level, thereby filling the shooting head only in part. Furthermore, the filled-in molding sand is flattened more or less by a closing flap of the outlet member, so that the core sand being within the shooting head is quasi evenly distributed. Nonetheless, also in this instance it is necessary to fill in a considerable quantity of core sand, even for shooting very small cores, since the filling with only a small amount of core sand would not supply all shooting nozzles with an adequate amount of sand. A complete filling of the shooting head still leaves, even after a flattening, the aforesaid ageing problem on the one hand and, on the other, the problem of penetrating the total supply of core sand in the shooting head with compressed air, so that the risk of unwanted preliminary compressions within the shooting head is incurred likewise in this instance.

In its not-yet published German Application P 42 08 647.7-24, applicant has already proposed itself a further solution to the problem with respect to the risk of a preliminary compression occurring inside the shooting head. To avoid an unwanted preliminary compression within the shooting head, a device is provided for generating a turbulence or for an even distribution of the compressed air flowing from the air supply into the shooting head, the device being a so-called streamline filter with slot-shaped passages. However, the ageing problem is thereby not solved.

Even a synopsis of the prior art known, on the one hand, from DE 41 28 952 C1 and relating to a filling device, and the turbulence of the compressed air required for the shooting by means of a streamline filter as claimed on the other hand in German Application P 42 08 647.7-24, will be able to alleviate at most, but will not solve the problem that arises in particular with the shooting of very small cores both with respect to the ageing of the binding agent within the shooting head and with respect to an unwanted preliminary compression within the shooting head.

It is therefore the object of the present invention to describe a shooting head for a core shooter for shooting foundry cores or molds, which is also suitable in particular for shooting very small cores.

SUMMARY OF THE INVENTION

The above and other objects and advantages of the present invention are achieved by the provision of a shooting head for a core shooter which includes a core sand guide system formed in the inside of the shooting head, with the core sand guide system extending substantially from the lower edge. of the maximally immersed outlet member, or from the filling level defined by the outlet member, to the shooting nozzles.

In accordance with the invention, it has been recognized that the core sand including binding agents that are to be filled into the shooting head must initially reach a minimum filling level, so as to even permit a filling with the filling device known, for example, from DE 41 28 952 C1, as well as a subsequent flattening of the filled-in sand. To avoid that the compressed air necessary for the shooting need not penetrate through a large amount of core sand, the shooting head is provided in accordance with the invention with a core sand guide system, which extends substantially from the lower edge of the maximally immersed outlet member of the filling device, or from the filling level defined by the outlet member, to the shooting plate or shooting nozzles. In other words, the core sand guide system starts already at the level of the surface of the filled-in core sand, or slightly below, so that both the core sand and the compressed air required for the shooting are channeled by the core sand guide system to at least a large extent. Furthermore, it is especially important that the core sand guide system occupy a rather considerable volume, by which the volume of the core sand required for the shooting is reduced, while the filling level remains unchanged. This favors quite considerably the shooting of very small cores in particular, thus reducing to a fairly large extent, on the one hand, the risk of ageing binding agents and, on the other hand, an unwanted preliminary compression as a result of a multiple application of compressed air.

With respect to the special configuration of the core sand guide system, it will be of advantage, when same is provided with channels extending to the shootings nozzles and, thus, forming a forced guidance for the core sand. Each of these channels could extend to one shooting nozzle, it being likewise possible, depending on the geometry of the core being shot, to supply via one channel two or more adjacent shooting nozzles both with core sand and with compressed air.

More specifically, the channels could taper toward the shooting nozzle, preferably in funnel shape, which will be the case, in particular when each of the channels extends to one shooting nozzle.

As regards a particularly effective distribution of the sand being filled into the shooting head, and likewise with respect to an approximately even distribution of the air required for the shooting, it will be of advantage, when the walls of the channels converge on the side facing away from the shooting nozzles, preferably in wedge shape. This convergence provides for a separation of the sand being filled in, and splits likewise the air current directed in direction toward the shooting nozzles into individual partial currents.

To avoid a high resistance to flow caused inside the shooting head or by the core sand guide system, on the one hand, with respect to the sand and, on the other hand, with respect to the compressed air necessary for the shooting, it will further be advantageous, when the core sand guide system, or its walls, have smooth sliding surfaces, which permit the core sand and the compressed to flow therealong unimpeded. Thus, the walls of the core sand guide system could be covered, for example, with a special slide coating.

With respect to a particularly stable configuration of the core sand guide system on the one hand, and with respect to a particularly simple construction of the "interior" of the shooting head on the other hand, it will be highly advantageous, when the regions between the walls are formed of a solid material. By the volume of this solid material, the volume available for receiving the core sand within the shooting head is reduced, so that the shooting of very small cores requires a core sand guide system with a large volume and the shooting of large cores a core sand guide system with a relatively small volume. In any event, as a result of the core sand guide system, the volume available for receiving core sand including binding agents is reduced quite considerably in the region between the nozzle plate or shooting nozzles and the filling level that is predetermined by the outlet member of the filling device, so that in this region the throughput of core sand increases, and that sand is precluded from precompacting already inside the shooting head by a multiple application of compressed air.

In a further advantageous manner, it would be possible to dimension the shooting head and the wall or regions between the channels of the core sand guide system as well as the channels themselves such that the quantity of core sand that can be filled in by the outlet member up to the filling level suffices for shooting only a single core. This measure would ultimately ensure that the core sand being in the shooting head quasi as a supply is precluded from being subjected to a multiple application of compressed air required for the shooting. Rather, the core sand subjected to compressed air is shot almost entirely through the shooting nozzles. However, it is necessary to keep always a minimum reserve in the region upstream of the individual shooting nozzles, so that in the event of an uneven filling none of the shooting nozzles remains undersupplied with core sand. Finally, the core sand guide system could be used for an adaptation to differences in filling quantities or in shooting weights from 60 to 1 kg, it being necessary to only modify the "interior", i.e., the core sand guide system including the arrangement of the shooting nozzles, while the outside dimensions of the shooting head remain unchanged.

There exist various possibilities of improving and further developing the teaching of the present invention in advantageous manner. To this end reference may be made to the following description of an embodiment of the invention with reference to the drawing. In conjunction with the description of the preferred embodiment of the invention with reference to the drawing, also generally preferred embodiments and further developments of the teaching are described.

DETAILED DESCRIPTION OF THE PREFERRED EMBODIMENT

Figure 1:
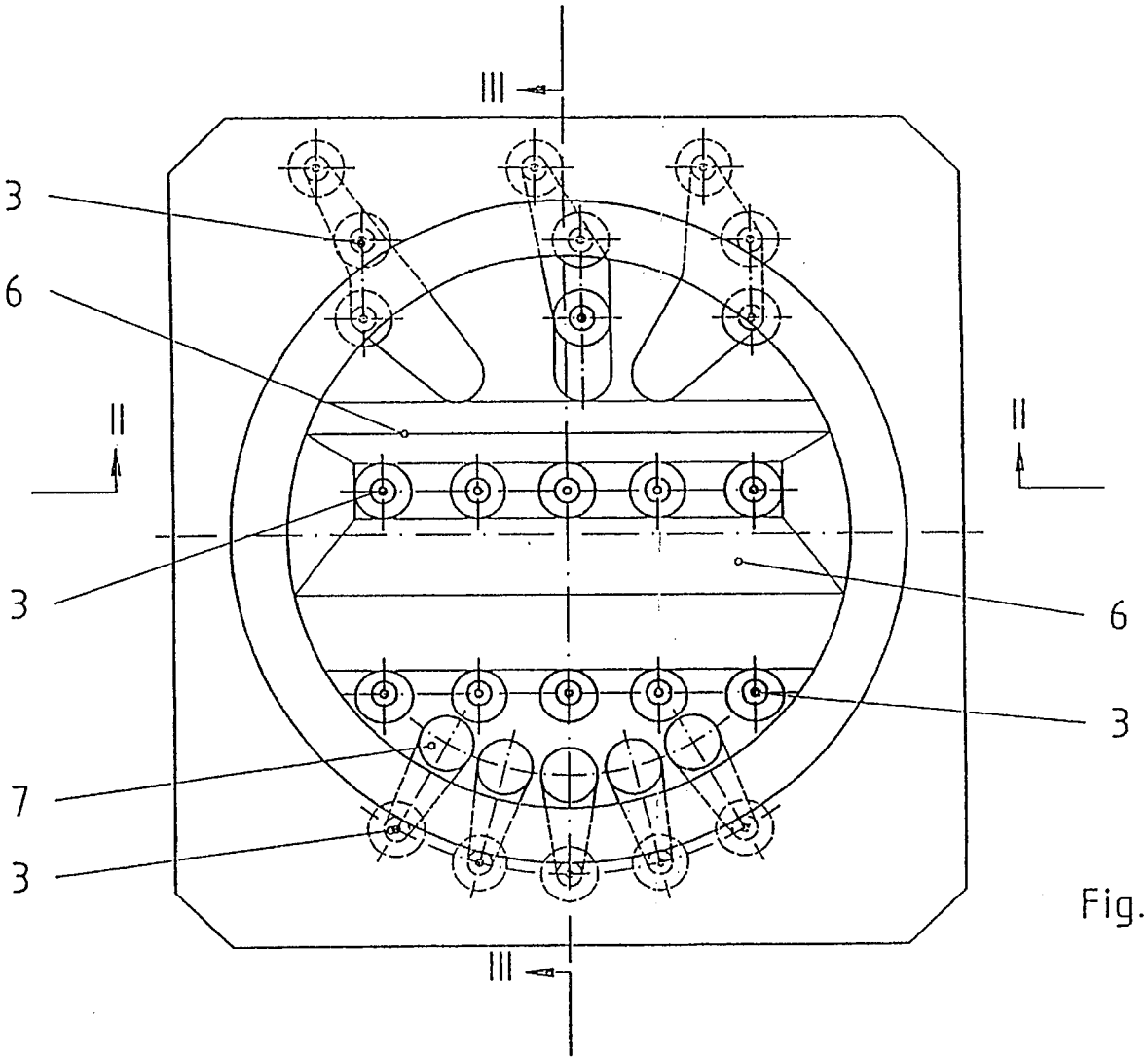
FIG. 1 is a schematic top view of an embodiment of an upwardly opened shooting head.
Figure 2:
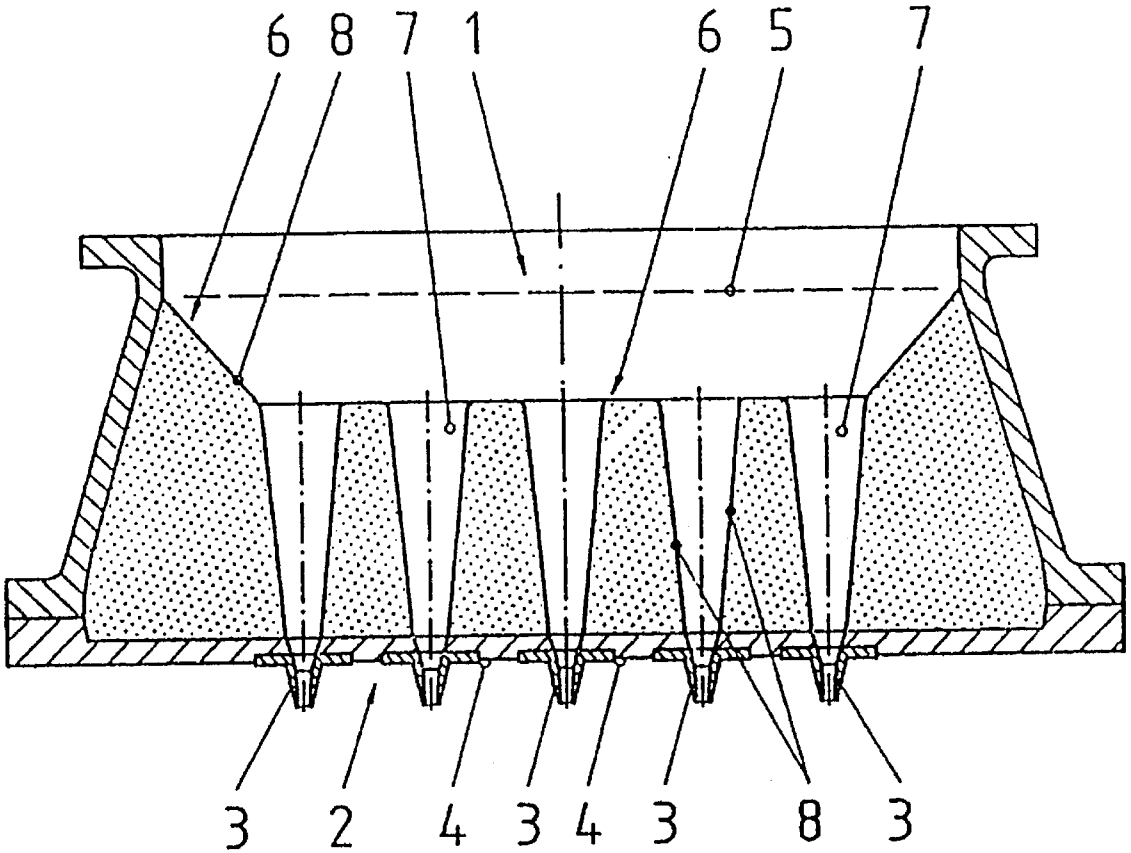
FIG. 2 is a schematic side view of the subject matter of figure along line II—II.
Figure 3:
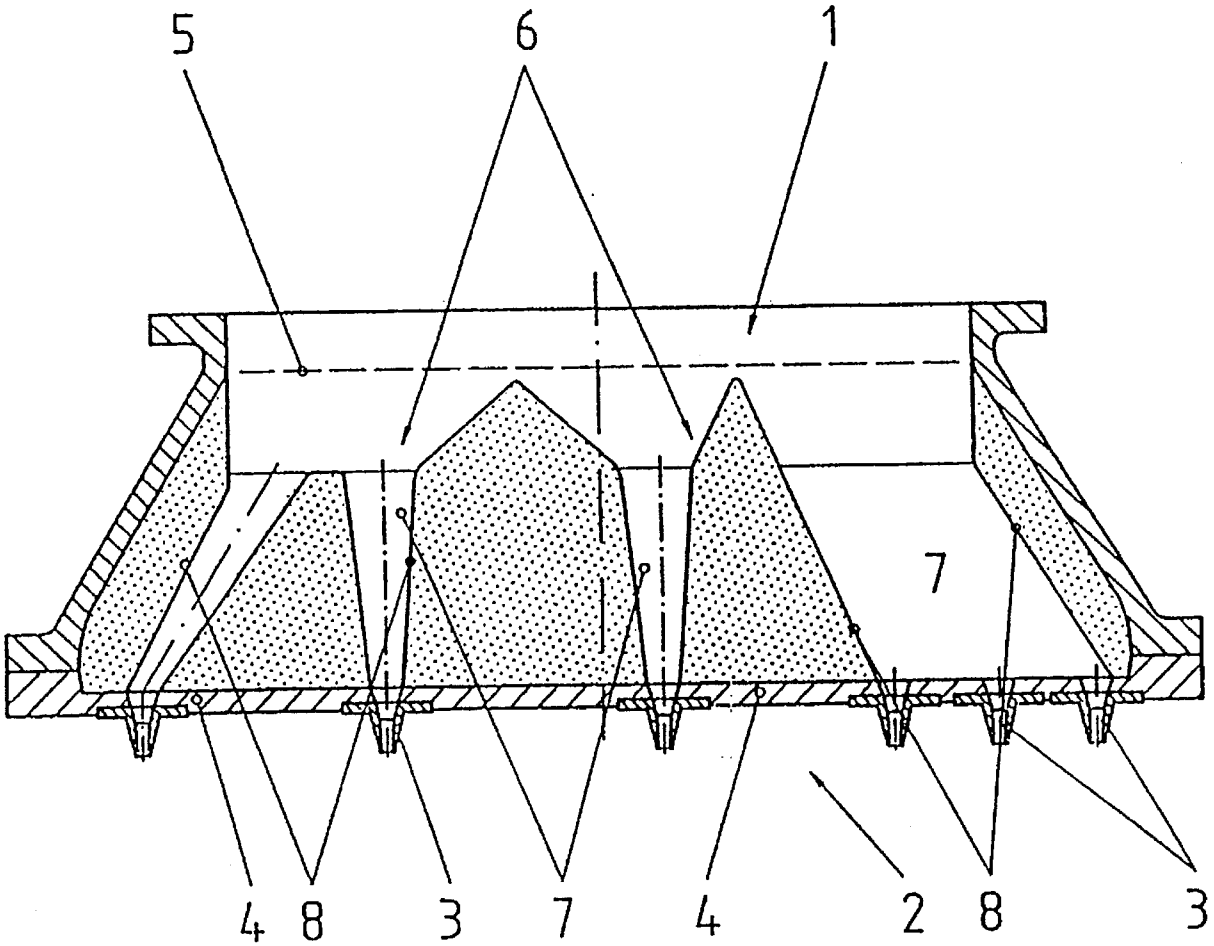
FIG. 3 is a schematic side view of the subject matter of FIG. 1 along line III—III.

Common to all figures is a shooting head for a core shooter not shown in the figures for shooting foundry core or molds. The shooting head has an inlet opening 1 for selective connection to a filling device immersing with its outlet member into the shooting head and predetermining therein the filling level, or to a clamping head serving to sealingly apply compressed air. Between the shooting head and the clamping head, a filter, also named streamline filter, may be provided, which is used to swirl the compressed air. Arranged at outlet end 2 is a shooting plate 4 accommodating shooting nozzles 3.

In accordance with the invention, a core sand guide system 6 is formed inside the shooting head, which extends substantially from the lower edge of the maximally immersed outlet member not shown in the figures, or from a filling level 5 defined by the outlet member, to shooting nozzles 3, this core sand guide system reducing the volume available for receiving the core sand quite considerably.

The core sand guide system 6 comprises channels 7 which form a forced guidance for the core sand. These channels 7 may extend either to a single shooting nozzle 3 or to several shooting nozzles 3. The channels 7 taper toward shooting nozzles 3 at least in one direction, so as to provide a kind of funnel effect.

On the side facing away from shooting nozzles 3, the walls 8 of channels 7 converge in wedge shape, so that both the core sand being filled in and the compressed air required for the shooting are urged to distribute.

The resistance to flow is decreased in that the walls 8 are provided with smooth slide surfaces, which may either be polished or be provided with a special slide coating.

Further indicated in the figures is that the regions between walls 8 consists of solid material. In the selected embodiment, it is especially important that the shooting head and the walls 8 or the regions between channels 7 as well as the channels 7 themselves be dimensioned such that the quantity of sand that can be supplied by the outlet member not shown in the figures up to filling level 5 suffices for shooting one core. In so doing, it is necessary to always supply a certain excessive amount of sand, so as to avoid that one of the shooting nozzles may be undersupplied with sand in an uneven filling.

Finally, the core sand guide system 6 provided in the shooting head of the present invention is used for an adaptation to differences in filling quantities or in shooting weights from 60 kg to 1 kg, so as to permit to shoot both very large and heavy cores and small cores with identical outside dimensions of the shooting head.

In conclusion, it should be noted that the foregoing embodiment has been used to describe only by way of example the teaching of the present invention, without limiting same thereto.

I claim:

1. Shooting head for a core shooter for shooting foundry cores or molds, the shooting head comprising an opening (1) at its inlet end for selective connection to a filling device immersed with an outlet member into the shooting head and defining therein a filling level (5), or to a clamping head serving to sealingly apply compressed air, and a shooting plate (4) arranged at its outlet end and accommodating shooting nozzles (3), characterized that inside the shooting head a core sand guide system (6) is formed, the core guide system (6) extending substantially from the lower edge of the maximally immersed outlet member, or from the filling level (5) defined by the outlet member, to the shooting nozzles (3), and being provided with channels (7) extending to the shooting nozzles (3), and that walls (8) defining the channels (7) converge in a wedge shape on the side facing away from the shooting nozzles (3).

2. Shooting head as in claim 1, characterized in that each channel (7) extends to at least one shooting nozzle (3).

3. Shooting head as in claim 1, characterized in that the channels (7) taper toward the shooting nozzles (3) in a funnel shape.

4. Shooting head as in claim 1, characterized in that the core sand guide system (6) or its wall (8) have smooth sliding surfaces.

5. Shooting head as in claim 1, characterized in that the regions between the walls (8) are formed of a solid material.

6. Shooting head as in claim 1, characterized in that the shooting head and the walls (8) or the regions between the channels (7) as well as the channels (7) are dimensioned such that the quantity of sore sand being supplied by the outlet member up to the filling level (5) is sufficient for shooting one core.

7. Shooting head as in claim 6, characterized in that the core sand guide system (6) is used for an adaptation to differences in filling quantities or to difference in shooting weights from 60 kg to 1 kg.

* * * * *

UNITED STATES PATENT AND TRADEMARK OFFICE

CERTIFICATE OF CORRECTION

PATENT NO. : 5,597,029

DATED : January 28, 1997

INVENTOR(S) : Werner Landua

It is certified that error appears in the above-identified patent and that said Letters Patent is hereby corrected as shown below:

Column 2, line 31, after "edge" omit the period (.).

Column 5, line 15, after "characterized" insert -- in --.

Column 6, line 7, "wall" should be -- walls --.

Column 6, line 15, "sore" should be -- core --.

Column 6, line 20, "difference" should be -- differences --.

Signed and Sealed this

Twelfth Day of May, 1998

Bruce Lehman

*Attest:*

BRUCE LEHMAN

*Attesting Officer*

*Commissioner of Patents and Trademarks*